United States Patent [19]

Piana

[11] 4,173,247

[45] Nov. 6, 1979

[54] CHAMBERED ELEMENT FOR USE IN FORMING A ROLLER SCREEN

[76] Inventor: Renato Piana, p.za S. Maria Novella 22, Florence, Italy

[21] Appl. No.: 922,379

[22] Filed: Jul. 6, 1978

Related U.S. Application Data

[63] Continuation-in-part of Ser. No. 778,228, Mar. 16, 1977.

[51] Int. Cl.[2] ..... E06B 3/12

[52] U.S. Cl. ..... 160/236; 160/220

[58] Field of Search ..... 160/201, 220, 232, 235, 160/236, 133

[56] References Cited

U.S. PATENT DOCUMENTS

| | | | |
|---|---|---|---|
| 546,858 | 9/1895 | Kinnear | 160/232 |
| 1,437,947 | 12/1922 | Probert | 160/235 |
| 1,910,047 | 5/1933 | Passoni | 160/220 |
| 2,959,221 | 11/1960 | Clapsaddle, Jr. | 160/201 |
| 3,633,647 | 1/1972 | Leitgeb | 160/220 |

FOREIGN PATENT DOCUMENTS

| | | | |
|---|---|---|---|
| 2109838 | 9/1972 | Fed. Rep. of Germany | 160/236 |
| 2505682 | 8/1976 | Fed. Rep. of Germany | 160/236 |
| 554436 | 1/1957 | Italy | 160/220 |
| 6804221 | 10/1968 | Netherlands | 160/236 |

*Primary Examiner*—Peter M. Caun

*Attorney, Agent, or Firm*—Harold L. Stowell

[57] ABSTRACT

A chambered element for use in forming a roller screen has a pair of longitudinally extending chambers separated by a common wall and means are provided by the wall-forming elements of one of the chambers for coupling a co-extending finishing member.

7 Claims, 5 Drawing Figures

CHAMBERED ELEMENT FOR USE IN FORMING A ROLLER SCREEN

CROSS-REFERENCE TO RELATED APPLICATION

This application is a continuation-in-part of application Ser. No. 778,228, filed Mar. 16, 1977.

BRIEF SUMMARY OF THE INVENTION

The present invention concerns a tubular rod or element, the longitudinal edges of which are provided with members to link the rod with adjacent rods in order to provide roller screens such as, for instance, roller blinds.

There are tubular rods known in the art formed of extruded plastic or metallic materials in such a way that the longitudinal edges are fully shaped to obtain articulated concatenating members for a succession of the above-mentioned rods, capable of forming a screen or blind wound onto a corresponding drum. The rods of the above-mentioned type already known in the art show several drawbacks, so as to limit the application thereof; for example, the rods made of plastic material are subject to a quick deterioration if they are directly exposed to atmospheric agents because they readily age or become brittle when directly exposed to the sunlight.

On the other hand, as regards metal rods, although being more resistant to atmospheric agents, they do not allow for a satisfactory and complete heat insulation. Furthermore, when the metal rods are made of aluminium or of alloys, that is, of materials subject to easy deterioration by atmospheric agents, the rods require the application thereto of protective coatings, obtainable, for example, by means of anodic oxydation.

A primary object is to provide a roller blind assembly including a pair of longitudinally extending side-by-side hollow chambers to provide improved insulating properties for the assembly.

The purpose of the present invention is the embodiment of a tubular rod of the above-mentioned type, having none of the aforementioned drawbacks and, at the same time, allowing for the realization of entirely satisfactory weatherproof screens, the surfaces whereof, in particular the visible surfaces, are capable of meeting any practical requirement including a pleasing appearance.

Another purpose of the present finding is the embodiment of rods of the aforesaid type which may be formed of plastic materials, or of metallic materials, without the need to resort to the use of special equipment.

The rod, object of the present invention, having one or more complemental longitudinal cavities and shaped, longitudinal edges, such as to form articulate concatenating members for linkage with the adjacent rods, is further characterized in that at least one of the longitudinal surfaces thereof consists of a complemental finish member extending along the longitudinal edges of the rod and provided with members designed to couple said finish member with the said rod.

According to a preferred embodiment of the rod claimed with the present invention, the rod has at the longitudinal edges thereof or next to the said edges, inclined or springed wings, which can be brought in engagement with complemental, longitudinal edges of a finishing member.

It is understood that the said complemental finish member can be made of materials having the desired characteristics, for example, of wood, metal, or of such other materals capable of meeting in each case, the desired requirements including that of a pleasant aspect.

BRIEF DESCRIPTION OF THE ART

The invention will be now explained in the following description, with reference to the annexed drawing showing, by way of example, some forms of embodiment of the rod object of the present invention.

DETAILED DESCRIPTION

Figure 1:
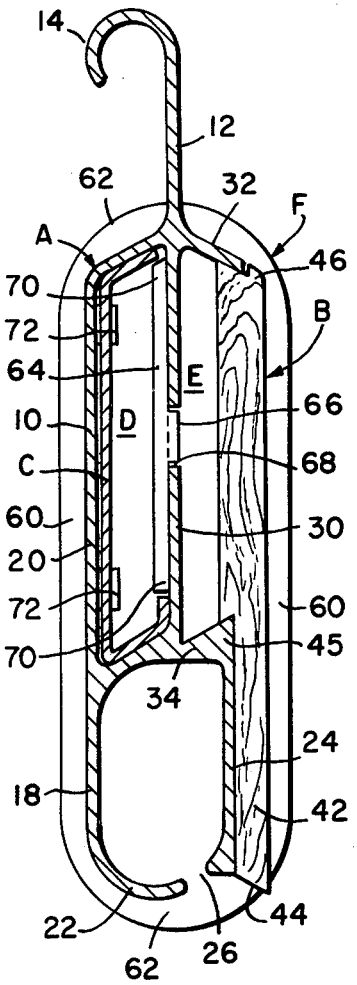
FIG. 1 shows a cross-section of the rod according to the present invention.

With reference to FIG. 1 of the drawing, the rod shown therein consists of two elements A and B respectively with a pair of generally dead air spaces D and E therebetween. The first element A forms the rod proper while the second B forms a complemental part of the first.

Element A is formed with a portion 10 of tubular configuration. Element A has above the longitudinal ends thereof, a median wing 12, the end 14 whereof is hook-like bent; and below a second wing 18 which forms an extension of the outer wall 20 of the said element 18. The free end of the lower or second wing 18 is bent upwardly to form a hook-shaped wing 22, to delimit, with a wing 24 (forming the inner extension of the wall opposite to the aforesaid wall), an inserting slot 26, capable of housing wing 12 of the rod situated below the aforesaid rod. Therefore, it appears evident, that the complemental parts 12–14 and 18–22 are articulated linking or concatenating members, in such a way that the succession of rods provides for the formation of the roller blind which winds onto a supporting drum.

According to the present invention, the front wall 30, opposite to the wall 20 of portion 10, extends downward to form the aforementioned wing 24 which delimits the inserting opening 26. Front wall 30 has at the upper part thereof, a sloping wing 32 and, at its lower part, at the tip of wing 24, an inclined projection 34 which forms, together with the said wall, an angle of less than 90°, said projection being orientated in a direction opposite to that of wing 32. The longitudinal, inclined edges of the complemental element B engage the opposite faces of wing 32 and of projection 34. As a consequence, element 10 has at the longitudinal edges thereof, the opposite faces of wings 32 and 34 orientated with opposite inclinations, in such a way as to form, together with the above-mentioned wall 30, a number of tongue-and-groove housings. At least one of wings 32 and 34 is capable of exerting an elastic action, for the purpose of firmly retaining the complemental element B.

With reference to FIG. 1, complemental element B consists of a bar, the longitudinal edges whereof are inclined in opposite directions, to elastically engage wings 32 and 34 in such a way that said complemental element B is retained by means of member 10 in spaced relation to wall 30 to provide the second air space E. The first air space being between wall 20 and wall 30.

Complemental element B shows at the lower side thereof, a longitudinal appendix 42, to cover and to adhere to the above-described lower wing 24.

The above-mentioned free edge of appendix 42 has an inclined chamber 44, extending parallel with wing 32 of the element adjacent to the aforementioned element, to facilitate the winding-motion of the elements which form the blind. To prevent the accumulation of water in the channel formed downwardly with project 34 and with wall 30, holes or slots 45 are provided in the said channel or groove, through which the water is allowed to discharge to the outside.

From the foregoing, it is evident that Rod A can be realized appropriately by following the known processing methods, such as used for the extrusion of metals or of plastic material. Also complemental element B can be realized in the same way, bearing in mind that in the case shown in FIG. 1, said element is illustrated as wooden, it remaining understood that the said element can be made as well of an extruded plastic material.

The assembly of the above-described rods is made by threading the complemental element B into the groove formed with the wings 32 and 34 respectively of element A in such a way that elastic wing 32 engages by elastic constraint the longitudinal edges of the element B.

Figure 2:
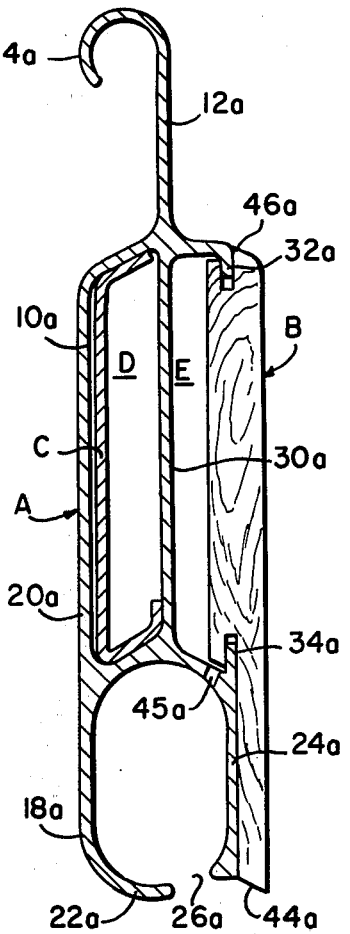
FIGS. 2 and 3 are like representations of different embodiments of the rod.
Figure 3:
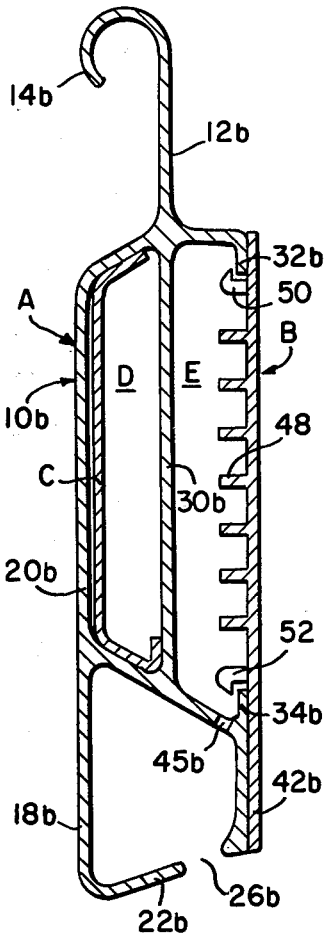

Now, giving consideration to the different embodiments shown in FIGS. 2 and 3, it can be noted that the parts identical with or corresponding to the part of the illustrated rod are distinguished with the same reference marks. In the case of FIG. 2, the main element A is provided at the face thereof opposite to wall 20*a*, with angular projections 32*a* and 34*a*, the edges of the said projections are opposed and housed in grooves formed by the longitudinal edges 45*a* and 46*a* of complemental element B, made also in this case of wood. In this embodiment the thickness of element B is such as to project over a certain length from the opposite wall 30*a* of the main element 10*a*. In the case shown in FIG. 3, element 10*b* has square-shaped wings 32*b* and 34*b* respectively designed to retain element B which in the case concerned is metal or laminated plastic material, the inner surface whereof is provided with stiffening ribs 48. The element B has in the neighborhood of its edges, teeth 50 to engage the projections 32*b* and 34*b*. The teeth 50 are discontinuous or continuous elements, capable of exerting an elastic action, such as to stably engage the edges of the square-shaped winges 32*b* and 34*b*. Also in the variants, the bottom of the channels or grooves formed with the square wings 32*a* and 34*a* are provided with openings such to prevent water accumulation.

Figure 4:
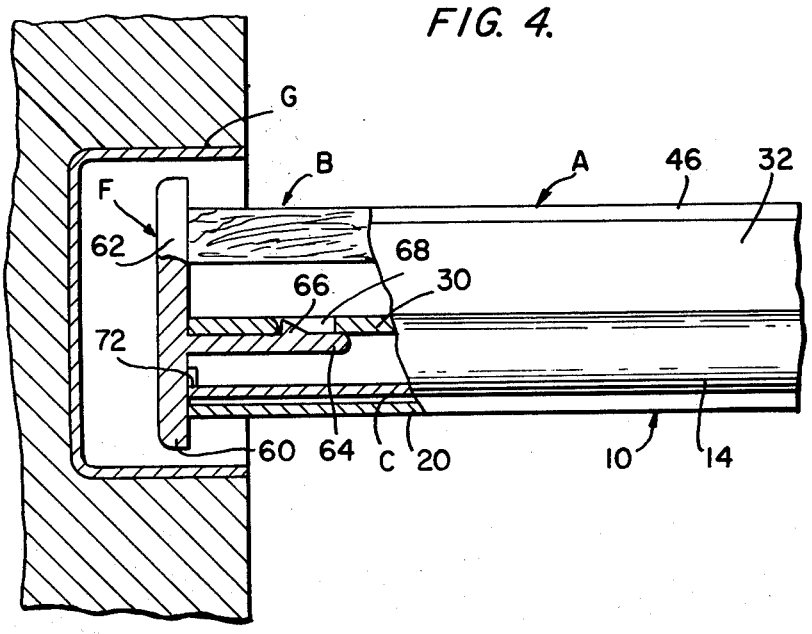
FIG. 4 is an end view of the rod according to FIG. 1, with some parts thereof broken away.
Figure 5:
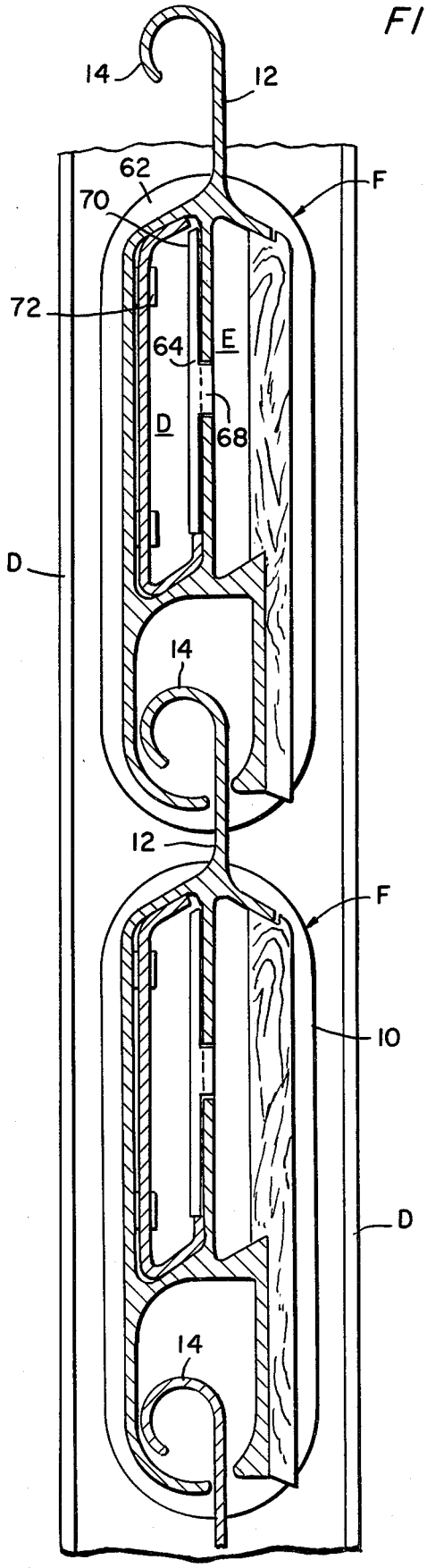
FIG. 5 is a diagrammatic view illustrating how the elements shown in FIG. 1 would be assembled to form a roller blind.

For the purpose of ensuring the mutual longitudinal retention of the rods which form a roller blind and dampen the noise which is produced when the said roller blind is operated, the said rods which engage the corresponding guide rails G, FIG. 4 are provided with ample play at the ends thereof and with appropriate guide-plates F.

FIG. 4 illustrates one of the ends of the rod shown in FIG. 1, the said end being provided with a guide-plate F which is in engagement with the groove of the matching guide-rail G. It is, however, understood that it is possible to fit plates F also to the rods shown in FIGS. 2 and 3.

The illustrated plate F is rectangular in shape and made of advantageous materials, such as, for instance, stamped plastic materials which besides damping the noise that develops during the blind handling operation, are also self-lubricating materials.

The longitudinal edges 60 and the transversal edges 62 of the plate project, over a certain extension, from the peripheral sides 20 and 32 of the rod concerned. In particular, the longitudinal sides 60 of the plate cooperate with the opposed inner walls of guide-rail G to guide the roller blind during the displacements thereof. Correspondingly, the transversal sides 62 of the plate, which also project advantageously from the tranversal ends of the rod, constitute stops for the rods adjacent to the above-mentioned rods, besides providing for the mutual alignment of the rods of the roller screen or roller blind.

The retention of plates F are attached to the ends of each of the rods, by means to tongue-and-groove members. For this purpose, plate F has at one of the faces thereof one or more spring wings 64 each of which have at least one tooth 66 which can be brought into engagement with a matching opening 68. The opening 68 being pierced through one of the walls designed to delimit the longitudinal openings of the rod. For example, the opening or openings 68 can be pierced through the wall 30, as illustrated in FIG. 4 and/or through the opposed wall 20. In any case, the openings concerned are accessible from the outside in order to inflect by means of an appropriate tool, wing 64, in order to disengage the tooth from the matching opening, thus, permitting the removal of the plate.

To provide a satisfactory anchorage of plates F to the rods, the longitudinal edges 70 of wings 64, engage the transversal walls of the longitudinal openings of the rods. When plate F is provided with only one elastic wing 64, as shown in the illustrated case, the rear side of the said plate has projections 72 to engage the inner edges of the walls which delimit the longitudinal opening or openings of the rod, so as to firmly connect the plate with the said rod, as well as to establish the desired position of said plate in respect to said rod.

The case should not be disconsidered, in which the attachment of the plates F to the rod ends is carried out by means of shaped projections, such as those of complemental elements B, in order to thread said projections into the interstices between wings 32 and 34.

Taking into account the application of the rod according to the present invention to form roller blinds or the like, the said are so installed, that elements B are faced outwardly, that is, directly exposed to the action of the sunrays and to the rain. To realize the said purposes, said complemental element B is embodied by using appropriate materials or materials capable of resisting bad weather or such as to allow for the heat insulation thereof.

Still in the case of roller blinds specifically, the main element 10 can be made of extruded plastic material, which, since it is concealed from the action of atmospheric agents, is sufficiently protected; and furthermore, it is protected from aging influences. As a consequence, the so-embodied rod has a long life.

Still further, it is possible to provide the said elements in longitudinal direction, with reinforcing bars C of the metallic type.

Finally, according to the present invention, it is an easy matter to provide pleasant effects; in other words, it is possible to embody roller blinds, the outer surfaces whereof are pleasant to look at, that is, the surfaces shown at the right hand side of FIGS. 1 and 3, which can be agreeably colored, ensuring at the same time a perfect heat insulation thereof.

I claim:

1. A rod assembly for use in forming a roller screen, said rod assembly comprising a first element having a pair of longitudinally extending, hollow chambers, a common wall separating said chambers, coupling members along the longitudinal edges of the wall means forming one of the hollow chambers, a finish element, said finish element having coupling members formed thereon cooperating with the coupling member along the longitudinal edges of said one of the hollow chambers, said finish element being detachably coupable to said edges of wall means of said one hollow chamber, the effective width of said finish element when coupled to the edges of the said wall means being less than the width of said one hollow chamber such that a pair of side-by-side air spaces are provided in each rod assembly.

2. The invention defined in claim 1 wherein the finish element is made of an extruded material.

3. The invention defined in claim 1 wherein the coupling members along the longitudinal edges of the wall means forming said one chamber are surfaces inclined toward each other, and the coupling members on said finish elements comprise inclined surface receiving slots.

4. The invention defined in claim 1 including drain openings formed in the lower inclined surface.

5. The invention defined in claim 1 including guide-plates at each end of the rod assembly having a greater surface area than the rod.

6. The invention defined in claim 1 wherein said coupling member along the longitudinal edges of the wall means forming one of the chambers comprise spring wings, elastically griping the said second element.

7. The invention defined in claim 6 wherein said spring wings project toward each other.

* * * * *